US005556568A

United States Patent [19]

Niwa et al.

[11] Patent Number: 5,556,568

[45] Date of Patent: Sep. 17, 1996

[54] SLIDE GATE PLATE

[75] Inventors: Shigeki Niwa, Toyoake; Etsuhiro Hasebe, Kariya; Kazuo Itoh, Chiryu; Toshihiro Indoh, Nagoya; Masamichi Asai, Kariya, all of Japan

[73] Assignee: Toshiba Ceramics Co., Ltd., Tokyo, Japan

[21] Appl. No.: 420,779

[22] Filed: Apr. 12, 1995

[30] Foreign Application Priority Data

Apr. 12, 1994 [JP] Japan ..... 6-073177

[51] Int. Cl.[6] ..... B22D 41/30

[52] U.S. Cl. ..... 222/600; 266/DIG. 1

[58] Field of Search ..... 266/45, 236, DIG. 1; 222/590, 600

[56] References Cited

U.S. PATENT DOCUMENTS

| | | | |
|---|---|---|---|
| 4,415,103 | 11/1983 | Shapland et al. | 222/600 |
| 4,978,053 | 12/1990 | Ohsawa | 228/149 |
| 5,151,201 | 9/1992 | Fishler et al. | 222/600 |

FOREIGN PATENT DOCUMENTS

| | | | |
|---|---|---|---|
| 50-101514 | 8/1975 | Japan . | |
| 51-84740 | 7/1976 | Japan . | |
| 57-36364 | 8/1982 | Japan . | |
| 1-15270 | 1/1989 | Japan . | |
| 3-124365 | 5/1991 | Japan . | |
| 5-200531 | 8/1993 | Japan . | |
| 2174030 | 10/1986 | United Kingdom | 222/600 |

*Primary Examiner*—Scott Kastler
*Attorney, Agent, or Firm*—Foley & Lardner

[57] ABSTRACT

A slide gate plate serving as a molten metal flow-rate control member for use in a molten metal discharging device, comprising an assembly of at least one stationary plate having a nozzle hole therein and a slide plate having a nozzle hole therein, the plates being designed so that one of the plates is thicker than the other plate by 1.5 mm or more. With this construction, the slide gate plate is reusable by polishing the sliding face off a worn plate for reuse.

22 Claims, 2 Drawing Sheets

SLIDE GATE PLATE

BACKGROUND OF THE INVENTION

1. Field of the Invention

This invention relates to a molten metal flow rate (amount) control member for use in a molten metal discharging device which is mounted at a lower portion of a container such as a ladle or a tundish for molten metal such as molten steel, etc. and particularly to a slide gate plate for the flow rate control member.

2. Description of Related Art

A molten-metal flow rate (amount) control device for adjusting or ceasing discharge of molten metal such as molten steel, etc. in a molten metal container has been frequently used for a molten metal discharging device which is mounted at the lower side of a molten metal container. This type of molten metal flow-rate control device has a slide plate and a stationary (fixed) plate each of which is built in the device and has a nozzle hole therein, and the flow rate (amount) of molten metal is controlled by slidingly displacing the slide plate relatively to the stationary plate so the nozzles of the slide plate and the stationary plate are faced to each other to open a passage bore for molten metal through which molten metal is passed or the nozzles are not faced to each other (i.e., positionally deviated from each other)to close the passage bore for molten metal. An assembly (combination) of the slide plate and the stationary plate has been well known as a slide gate plate which constitutes an important part of the flow-rate control device for molten metal.

As described above, a conventional slide gate plate is mainly fabricated with a slide plate and a stationary plate, and a two-plate type or a three-plate type is usually used for the slide gate plate. A two-plate type slide gate plate is fabricated by assembling (combining) a single stationary plate 1 and a single slide plate 2 as shown in FIG. 1. In this case, two plates having the same thickness are used for the stationary plate 1 and the slide plate 2 respectively. On the other hand, a three-plate type slide gate plate is fabricated by assembling two stationary plates 3 and 4 and a single slide plate 5 so that the slide plate 5 is sandwiched between the upper and lower stationary plates 3 and 4 as shown in FIG. 2. Plates having the same thickness are used for the stationary plates 3 and 4. This three-plate type slide gate plate is disclosed in Japanese Laid-open Utility Model Application No. Sho-50-101514.

In the case where such a slide gate plate is worn or damaged during its use, with respect to the two-plate type slide gate plate, all plates constituting the damaged slide gate plate must be exchanged for new ones. On the other hand, with respect to the three-plate type slide gate plate, if a slide plate interposed between stationary plates is worn or damaged, only the slide plate is exchanged for a new one, however, if a stationary plate is worn or damaged, all the plates are disused and exchanged for new ones.

The following is the reasons why a plate whose surface is worn is exchanged for a new plate to reuse a damaged slide gate plate. If a worn plate (a stationary plate or sliding plate whose sliding face is worn) is polished for reuse, the polished plate itself would become thinner due to the polishing treatment, and thus proper sliding face pressure could not be obtained, so that molten metal may leak from a gap between the plates with high probability. Therefore, it has been generally avoided to repair a damaged (worn) plate with a polishing treatment or the like and reuse it.

However, the slide gate plate (each plate constituting the slide gate plate) itself is an expensive member, and it is liable to be greatly damaged due to its use under a severe environment, so that the exchange frequency of the slide gate plate (plates) increases. Therefore, the slide gate plate itself has been strongly required to be reused as much as possible in consideration of its cost. Particularly, it is uneconomical to disuse a plate and exchange it for a new one even when only the sliding face thereof is merely damaged.

In view of the foregoing, U.S. Patent application Ser. No. 150,585 filed on Jun. 7, 1971 (corresponding to Japanese Post-examined Utility Model Application No. Sho-57-36364) proposed a technique which could avoid the above problem. In this proposed technique, the slide plate and the stationary plate are transposed so that the right and left sides of the sliding reciprocating face thereof are positionally exchanged each other when the slide plate is worn due to its use for a prescribed period. With this transposition, each of the stationary plate and the slide plate comes into sliding contact with a new face.

However, with even the transposition technique as described above, it has been impossible to reproduce any plate whose sliding face is damaged during its use, and thus there has been achieved no excellent countermeasure which basically meets a requirement for reproduction of damaged slide gate plate (plates).

As described above, reusability of the slide gate plate (plates) has been required for a long time, and various polishing treatments to enable reuse of the plates have been considered and studied among skilled persons (experts) in the art. However, those persons have finally failed as follows: it has been impossible to obtain proper sliding face pressure, it has been impossible to remove only a damaged portion for a greatly-damaged plate by merely polishing the damaged plate slightly, so that reuse of the plate (slide gate plate) is impossible, etc. Accordingly, it has been practically adopted that damaged plates are not reused, and all plates are exchanged for new ones when they are used for a prescribed period or when they are damaged during its use.

SUMMARY OF THE INVENTION

An object of the present invention is to provide a slide gate plate which can be reused by polishing the sliding face thereof even when the sliding face after used is worn or damaged.

In order to attain the above object, according to a first aspect of the present invention, a slide gate plate which constitutes a molten-metal flow rate control member for a molten metal discharging device is fabricated by assembling a stationary plate and a slide plate each having a nozzle hole therein, in which one of the plates is designed to be thicker than the other plate by 1.5 mm or more in thickness. Each of the plates is preferably designed to be symmetrical at the right and left sides thereof (in a slide direction) with respect to the nozzle hole thereof.

According to a second aspect of the present invention, a slide gate plate which constitutes a molten-metal flow rate control member for a molten metal discharging device is fabricated by assembling upper and lower stationary plates each having a nozzle hole therein and a slide plate which has a nozzle hole therein and is interposed between the upper and lower stationary plates, in which the upper and lower, stationary plates are designed so that the difference in thickness between the upper and lower stationary plates is set to 1.5 mm or more. Each of the plates constituting the slide gate plate is preferably designed to be symmetrical at the right and left sides thereof (in a sliding direction) with respect to the nozzle hole thereof.

In the slide gate plate according to the first aspect of the present invention, it is preferable that a ring having resistance to melt (melt-damage) (hereinafter referred to as "melt-resistant ring) is engagedly inserted into at least one of the nozzles of the stationary plate and the slide plate. Furthermore, in the slide gate plate according to the second aspect of the present invention, it is preferable that a ring which has a small melting loss or high resistance against chemical corrosion (melting damage) (hereinafter referred to as "melting-resistant ring") is engagedly inserted into at least one of the nozzles of the slide plate and the upper and lower plates. The melting-resistant ring is preferably formed of alumina-mullite material or alumina-carbon material.

In the slide gate plates according to the first and second aspects of the present invention, each plate is preferably covered with iron shell. The thickness difference between the stationary plate and the slide plate in the slide gate plate of the first aspect or between the upper and the lower stationary plates in the slide gate plate of the second aspect is preferably from 2 to 3 mm.

In the slide gate plates according to the first and second aspects of the present invention, each of the plates is preferably designed to have a double-layer structure which contains a main body member and a sliding face formed of an abrasion-resistant member which has higher abrasion-resistance than the main body.

According to a third aspect of the present invention, a slide gate plate which constitutes a molten-metal flow rate control member for a molten metal discharging device is of a two-plate type in which a stationary plate and a slide plate of the two-plate type are designed to be different in thickness or of a three-plate type in which upper and lower stationary plates of the three-plate type are designed to be different in thickness, wherein any one of the stationary plate and the slide plate of the two-plate type or any one of the upper and lower stationary plates of the three-plate type is designed to be thicker than the other plate by 1.5 mm or more, preferably by 2 to 3 mm. By merely designing a slide gate plate so that any one of plates constituting the slide gate plate is designed to be thicker than the other plate(s) by 1.5 mm or more, preferably by 2 to 3 mm, the slide gate plate can be readily installed into a conventional molten metal discharging device, and in addition the thicker plate can be reproduced and reused. Therefore, the slide gate plate of the present invention is still more effectively usable for industrial applications as compared with the conventional slide gate plate in which all plates must be exchanged for new ones. If the thickness difference is less than 1.5 mm, the plates are not reusable by the polishing treatment. On the other hand, if the thickness difference is more than 3 mm, it is generally hard to directly install the slide gate plate into the conventional molten metal discharging device.

According to the present invention, the plates thus formed are used for the slide gate plate for the molten metal flow-rate control member of the molten metal discharging device, and a discharging process of molten metal is conducted on the slide gate plate. When the sliding faces of the plates are worn or damaged during the discharging operation of molten metal, the sliding face of one plate having a larger thickness is subjected to a polishing treatment or the like to scraping the surface portion thereof to some extent. In this case, even when the surface portion of the sliding face of the one plate is scraped off to some extent, the plate has still a sufficient thickness to be capable of using as a thinner plate in a next stage with a new thickner plate because it has a larger thickness originally. Therefore, the sliding face pressure of the slide gate plate is not reduced even when the polishing treatment is conducted on the plate, and thus the polished plate is reusable. In this case, the other plate (thinner plate) which faces the thicker plate to be polished is exchanged for a new thicker plate, and the polished plate and the new plate are assembled into a slide gate plate which is substantially like a new slide gate plate. Therefore, the cost can be reduced and this is industrially favorable.

DETAILED DESCRIPTION OF THE PREFERRED EMBODIMENTS

Preferred embodiments according to the present invention will be described in detail with reference to the accompanying drawings. In the following description, various embodiments will be described in detail, however, the present invention is not limited to these embodiments.

Figure 1:
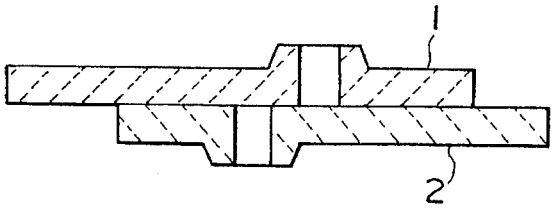
FIG. 1 is a cross-sectional view showing a conventional two-plate type slide gate plate.
Figure 2:
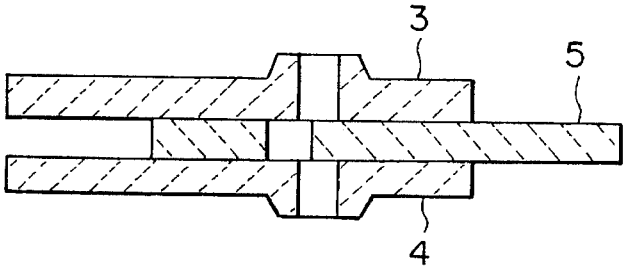
FIG. 2 is a cross-sectional view showing a conventional three-plate type slide gate plate.
Figure 3:
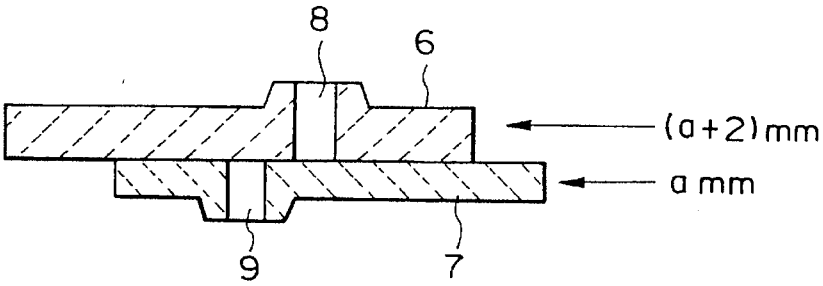
FIG. 3 is a cross-sectional view showing a slide gate plate according to a first embodiment of the present invention.

FIG. 3 is a cross-sectional view showing a slide gate plate of a first embodiment of the present invention. The slide gate plate of this embodiment is a two-plate type having a stationary plate 6 having a nozzle hole 8 and a slide plate 7 having a nozzle hole 9. In the present invention, the difference in thickness between the stationary plate 6 and the slide plate 7 is set to 1.5 mm or more. In the embodiment shown in FIG. 3, if the thickness of the stationary plate 6 is set to (a+2) mm, the thickness of the slide plate 7 is set to a mm, where a represents a prescribed constant). That is, the stationary plate 6 is designed to be thicker than the slide plate 7 by 2 mm.

In the two-plate type slide gate plate of the first embodiment shown in FIG. 3, the stationary plate 6 is thicker than the slide plate 7. Conversely, the slide plate 7 may be designed to be thicker than the stationary plate 6. The slide gate plate in which the thickness difference between the stationary plate 6 and the slide plate 7 is set to 1.5 mm or more can be installed into an ordinary molten metal discharging device for use. In this case, when the sliding face of the slide gate plate is worn or damaged during its use, the sliding face of the stationary plate 6 having a larger thickness is polished, and the slide plate 7 having a smaller thickness is disused and exchanged for a new thicker one. The polished stationary plate 6 (serving as a thinner plate) which has been slightly thinned due to the polishing treatment and the new slide plate (serving as a thicker plate) are assembled into a slide gate plate, and the slide gate plate thus assembled is installed and reused as a new slide gate plate in the molten metal discharging device.

Accordingly, a reproduced slide gate plate which is substantially like a new slide gate plate can be obtained by merely exchanging an used slide plate for a new one. Unlike the original slide gate plate, the new slide gate plate thus reproduced can be designed so that the slide plate is thicker than the polished stationary plate by selecting a new slide gate plate having a larger thickness than that of the polished stationary plate. Accordingly, after reuse of the new slide gate plate, the sliding face of the slide plate is polished whereas the stationary plate is exchanged for a new one, and the polished slide plate and the new stationary plate are assembled into a further new reproduced slide gate plate.

Alternatively, the stationary plate and the slide plate may be designed so that both the plates are compatible with each other (i.e., the nozzle holes of both the plates are positionally matched with each other), and so that the thickness difference between both the plates is set to 1.5 mm or more. In this case, when the sliding face of a slide gate plate is worn in the molten metal discharging device during its use, the sliding face of one thicker plate is polished and it is reused as a thinner plate. In addition, the other plate which is originally a thinner plate of the worn slide gate plate is disused, and exchanged for a thicker plate. The thicker plate and the polished thinner plate can be assembled into a new slide gate plate because of compatibility (positional matching) of the nozzle holes of these plates. By repeating this exchange method (that is, by repetitively polishing each thicker plate every time each slide gate plate is worn or damaged and assembling the polished plate and a new thicker plate into a new slide gate), the slide gate plate can be repetitively reproduced. According to this exchange system, only one plate may be prepared for reproduction of the slide gate plate at all times.

In this method, the thickness difference between the stationary plate and the slide plate corresponds to a margin of a thicker plate which will be polished and scraped off to be reused as a thinner plate, and it is dependent on the depth of a metal container for accommodating each plate. If the thickness difference of the plates increases excessively, the plates themselves cannot be moved when the plates are installed into a conventional molten metal discharging device. In addition, the thinner plate is excessively thin, so that it has mechanically insufficient strength. Therefore, it becomes impossible to perform a sliding operation. Conversely, if the thickness difference of the plates is excessively small, the margin of the thicker plate for polishing when the plate is worn or damaged would be reduced, and thus the polishing treatment would be insufficient, so that it would be impossible to reproduce and reuse the worn plate. Accordingly, the thickness difference between the stationary plate and the slide plate is set to 1.5 mm or more, and preferably to 2 to 3 mm in general, and it may be set to such a value that it can be installed into a well-known conventional molten metal discharging device.

Figure 4:
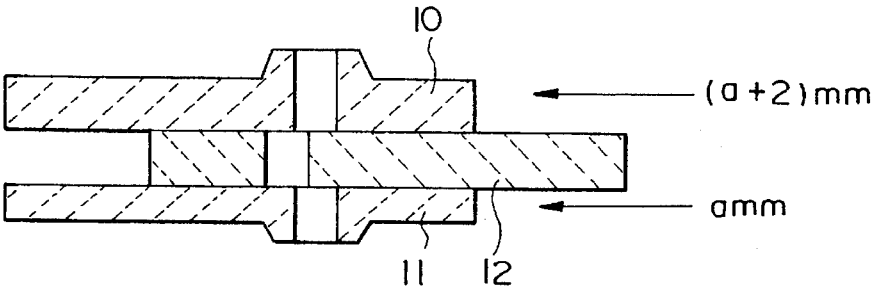
FIG. 4 is a cross-sectional view showing a slide gate plate according to a second embodiment of the present invention.

FIG. 4 is a cross-sectional view showing a three-plate type slide gate plate which is a second embodiment of the present invention, and it is usually used for a 280-ton ladle. In the slide gate plate of this embodiment shown in FIG. 4, a slide plate 12 is interposed between an upper stationary plate 10 and a lower stationary plate 11. The thickness of the lower stationary plate is set to a mm and that of the upper stationary plate is set to (a+2) mm. That is, the thickness difference between the upper and lower stationary plates is set to 2 mm.

Like the two-plate type slide gate plate shown in FIG. 3, the upper and lower stationary plates may be replaced for each other for reuse or these plates may be used without replacement.

Figure 5:
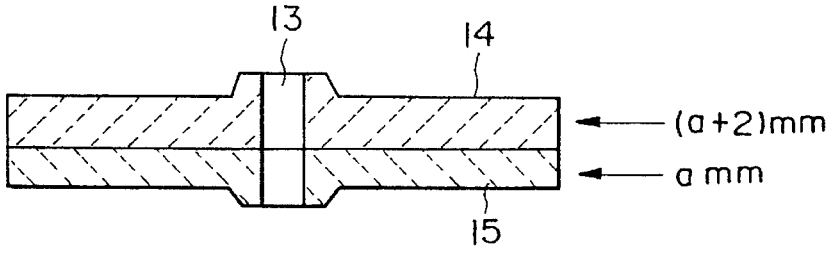
FIG. 5 is a cross-sectional view showing a slide gate plate according to a third embodiment of the present invention.

FIG. 5 is a cross-sectional view of a third embodiment of the present invention. In this embodiment, the same condition as the above embodiments is adopted for the thickness difference of the plates, and the plates are designed to be symmetrical at the right and left sides in a slide direction with respect to nozzle holes 13 for controlling a molten metal flow rate. Reference numeral 14 represents a stationary plate and reference numeral 15 represents a slide plate. In this embodiment, when the slide gate plate is reused, the plates may be reused so that the right and left sides thereof are transposed (positionally exchanged) to each other or the upper and lower plates are replaced for each other. Accordingly, when the plates are reused, it may be set without paying attention to orientation of the plates. That is, when the plates are used for a prescribed period in a state shown in FIG. 5 and then the sliding face of the thicker stationary plate 14 is polished for reuse, the polished stationary plate 14 may be reused as the slide plate 15 at the lower side of the slide gate plate, or it may be used in a state where the right and left sides are positionally exchanged to each other.

Figure 6:
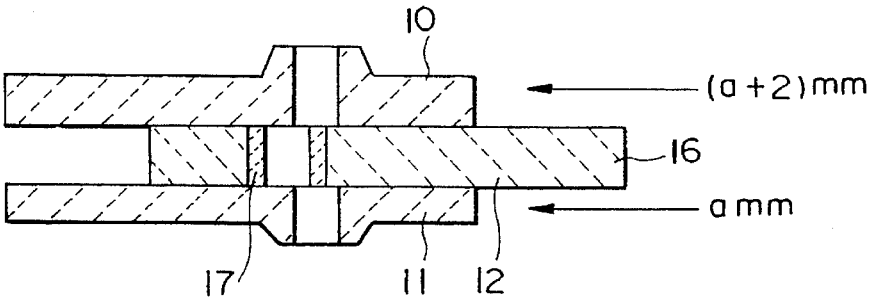
FIG. 6 is a cross-sectional view showing a slide gate plate according to a fourth embodiment of the present invention.

FIG. 6 is a cross-sectional view showing a slide gate plate according to a fourth embodiment of the present invention. The slide gate plate of this embodiment is a three-plate type slide gate plate in which the upper and lower stationary plates are designed to have a different thickness from each other like the embodiment shown in FIG. 4, and a melting-resistant ring 17 is engagedly inserted into the inner side of the nozzle hole of a slide plate 16. The same applicant of this application has proposed that a ring-shaped refractory member is engagedly mounted to a plate brick in Japanese Laid-open Patent Application Sho-64-19270. The nozzle hole is severely damaged by flow of molten metal, and the lifetime of the plate can be extended by engagedly inserting a melting-resistant refractory ring (ring having high resistance against chemical corrosion due to molten material) into the nozzle hole.

Figure 7:
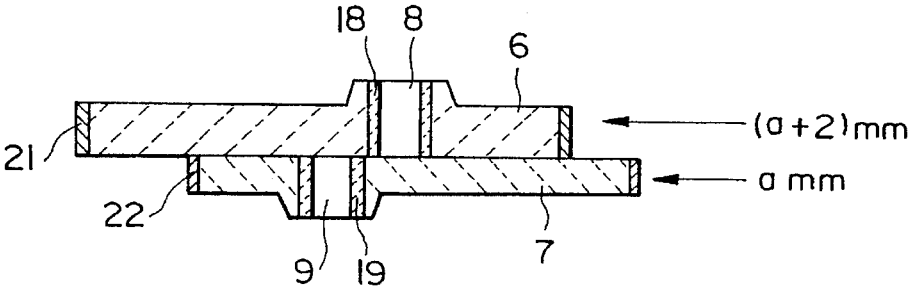
FIG. 7 is a cross-sectional view showing a slide gate plate according to a fifth embodiment of the present invention.

In FIG. 6, the ring 17 is engagedly inserted into the nozzle hole of the slide plate of the three-plate type slide gate plate. However, the melting-resistance refractory ring 17 may be engagedly inserted into the nozzle hole of the stationary plate. Likewise, the melting-resistant refractory rings 18 and 19 may be engagedly inserted into the nozzle holes of the stationary plate 6 and the slide plate 7 of the two-plate type slide gate plate as shown in FIG. 7. Alumina-mullite material or alumina-carbon material are suitably used for the melting-resistant refractory ring.

Various modifications may be made without departing from the subject matter of the present invention. For example, a multi-layered structure plate (stationary plate, slide plate) may be used for the slide gate plate. In this case, plural materials are laminated in the thickness direction of the plate to form a plate having a multi-layered structure, and the thickness difference as described above is set between plates thus formed. In this case, an abrasion-resistant material is suitably selected for the sliding face of the plate as described above, and other materials are used for the other lower layers, thereby forming a double-layered or three-layered structure plate. With this construction, the lifetime of the sliding face can be extended. In addition, when the plate is worn, the thicker plate can be polished and reused, so that the cost of equipment can be remarkably reduced.

Figure 8:
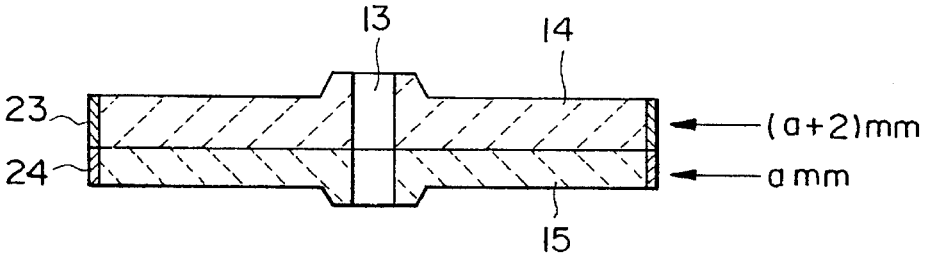
FIG. 8 is a cross-sectional view showing a slide gate plate according to a sixth embodiment of the present invention.

Furthermore, in the slide gate plate in which one plate is designed to be thicker than the other plate, a frame-type iron shell may be shrink-fitted to the peripheral side of each plate to firmly hold the plate. For example, in the embodiments shown in FIGS. 7 and 8, frame-shaped iron shells 21 and 22 are shrink-fitted to the peripheral sides of the stationary plate 6 and the slide plate 7, and frame-shaped iron shells 23 and 24 are shrink-fitted to the peripheral sides of the stationary plate 14 and the slide plate 15 to thereby prevent enlargement of cracks occurring in the nozzle holes of the plates or the like. Accordingly, like the above embodiments, the durability and the lifetime of the slide gate plate can be improved, and its use period can be lengthened. In addition, when the slide gate plate is worn, the thicker plate is polished and reused, so that the cost of equipment can be remarkably reduced. The technique of covering the periphery of a plate with an iron shell is a well-known technique, and the applicant has proposed a manufacturing process for a frame-shaped iron shell in U.S. Pat. No. 4,978,053 (Japanese Patent No. 1704768, Japanese Post-examined Patent Application No. Hei-3-69610). The slide gate plate of the present invention is not limited to a reciprocating type, and it may be suitably applied to a rotary type.

As described above, according to the present invention, the slide gate plate is designed so that one plate thereof is thicker than the other plate by a predetermined value, and thus the slide gate plate is formed of stationary and slide plates having different thickness. When the sliding face of the slide gate plate thus formed is worn or damaged during a molten-steel discharging operation therethrough, the sliding face of the thicker plate is polished and reused, and the other thinner plate is exchanged for a new one. The polished plate and the new plate are assembled into a slide gate plate which is substantially like a new slide gate plate. Therefore, the slide gate plate of the present invention can be economically reproduced.

The same effect as the two-plate type slide gate plate as described above can be also obtained in the three-plate type slide gate plate. Furthermore, the same effect can be also obtained in the plate which is symmetrically designed at the right and left sides thereof with respect to the nozzle hole thereof.

According to the present invention, only one plate may be exchanged for a new one when the slide gate plate is reused, and thus the number of plates to be exchanged can be reduced. In addition, the lifetime of one plate can be extended substantially twice. Furthermore, in addition to the above effect, those slide gate plates which have iron shells covered on the peripheral portion of the plates contained therein, the abrasion-resistant sliding face on the plates and the melting-resistant refractory rings in the nozzles hole of the plates can also an effect of suppressing crack of the plate, abrasion of the sliding face, damage of the nozzles, etc. Therefore, the durability of the slide gate plate is extremely excellent and the maintenance cost can be remarkably reduced, so that it is industrially remarkably effective.

What is claimed is:

1. A slide gate plate assembly serving as a molten metal flow-rate control member for use in a molten metal discharging device, comprising an of at least one stationary plate having a nozzle hole therein and a slide plate having a nozzle hole therein, said plates being designed so that one of said plates is thicker than the other plate by 1.5 mm or more.

2. The slide gate plate assembly as claimed in claim 1, wherein the thickness difference between said plates is set to 2 to 3 mm.

3. The slide gate plate assembly as claimed in claim 1, wherein each of said plates is designed to be symmetrical at the right and left sides thereof with respect to the nozzle hole thereof.

4. The slide gate plate assembly as claimed in claim 1, further comprising a melting-resistance ring which is engagedly inserted into the nozzle hole of at least one of said plates.

5. The slide gate plate assembly as claimed in claim 4, wherein said melting-resistant ring is formed of alumina-mullite material or alumina-carbon material.

6. The slide gate plate assembly as claimed in claim 1, further comprising an iron shell which is covered around a peripheral portion of at least one of said plates.

7. The slide gate plate assembly as claimed in claim 1, wherein each of said plates is designed in a multi-layered structure which contains a sliding face formed of abrasion-resistant material and a main body formed of at least one kind of different material.

8. The slide gate plate assembly serving as a molten metal flow-rate control member for use in a molten metal discharging device, comprising an of an upper stationary plate having a nozzle hole therein, a lower stationary plate having a nozzle hole and a slide plate which is interposed between said upper and lower plates and has a nozzle hole therein, said upper and lower stationary plates being designed so that one of said stationary plates is thicker than the other stationary plate by 1.5 mm or more.

9. The slide gate plate assembly as claimed in claim 8, wherein the thickness difference between said upper and lower stationary plates is set to 2 to 3 mm.

10. The slide gate plate assembly as claimed in claim 8, wherein each of said stationary plates and said slide plate is designed to be symmetrical at the right and left sides thereof with respect to the nozzle hole thereof.

11. The slide gate plate assembly as claimed in claim 8, further comprising a melting-resistant ring which is engagedly inserted into the nozzle hole of at least one of said stationary plates and said slide plate.

12. The slide gate plate assembly as claimed in claim 11, wherein said melting-resistant ring is formed of alumina-mullite material or alumina-carbon material.

13. The slide gate plate assembly as claimed in claim 8, further comprising an iron shell which is covered around a peripheral portion of at least one of said stationary plates and said slide plate.

14. The slide gate plate assembly as claimed in claim 8, wherein each of said stationary plates and said slide plate is designed in a multi-layered structure which contains a sliding face formed of abrasion-resistant material and a main body formed of at least one kind of different material.

15. A method for using a slide gate plate assembly serving as a molten metal flow-rate control member for controlling a flow rate of molten metal passing therethrough, comprising the step of:

arranging at least one of a stationary plate having a nozzle hole and a slide plate having a nozzle hole to constitute a slide gate plate so that one of the plates is thicker than the other plate by 1.5 mm or more.

16. A method for using a slide gate plate assembly serving as a molten metal flow-rate control member for controlling a flow rate of molten metal passing therethrough, comprising the step of:

arranging at least one of an upper stationary plate having a nozzle hole and a lower stationary plate having a nozzle hole to constitute a slide gate plate assembly so that a slide plate having a nozzle hole disposed between said upper and lower stationary plates and one of the stationary plates is thicker than the other plate by 1.5 mm or more.

17. The slide gate plate according to claim 1, wherein the thinner plate is a thicker plate which was had been polished to the thickness of a thinner plate.

18. The slide gate plate assembly according to claim 1, wherein the at least one stationary plate and slide plate have substantially the same shape except for thickness.

19. The slide gate plate as claimed in claim 8, wherein the thinner stationary plate is a thicker plate which was had been polished to the thickness of a thinner plate.

20. The slide gate plate assembly as claimed in claim 8, wherein the stationary plates have substantially the same shape except for thickness.

21. A method for using the slide gate plate assembly as claimed in claim 15, further comprising:

removing the thinner plate from a molten metal flow-rate controller;

moving the thicker plate into the position formerly occupied by the thinner plate; and inserting a further plate into the position formerly occupied by the thicker plate.

22. A method for using the slide gate plate assembly as claimed in claim 16, further comprising:

removing the thinner stationary plate from a molten metal flow-rate controller;

moving the thicker stationary plate into the position formerly occupied by the thinner stationary plate; and inserting a further stationary plate into the position formerly occupied by the thicker plate.

* * * * *